US005502626A

United States Patent [19]

Armstrong et al.

[11] Patent Number: 5,502,626

[45] Date of Patent: Mar. 26, 1996

[54] HIGH EFFICIENCY FLUORESCENT LAMP DEVICE

[75] Inventors: James B. Armstrong, Albuquerque, N.M.; J. Michael Lengyel, Ramona, Calif.

[73] Assignee: Honeywell Inc., Minneapolis, Minn.

[21] Appl. No.: 261,590

[22] Filed: Jun. 17, 1994

[51] Int. Cl.[6] ..... F21S 5/00; F21V 5/02; F21V 9/16

[52] U.S. Cl. ..... 362/216; 362/84; 362/332; 362/339

[58] Field of Search ..... 362/84, 216, 260, 362/223, 329, 330, 339, 332

[56] References Cited

U.S. PATENT DOCUMENTS

| | | | |
|---|---|---|---|
| Re. 33,987 | 7/1992 | Suzawa | 359/49 |
| 1,313,622 | 8/1919 | Dodds | 362/84 |
| 2,213,245 | 12/1936 | Germer | 362/84 |
| 2,317,265 | 7/1940 | Foerste et al. | 313/493 |
| 2,702,862 | 2/1955 | Finney | 362/84 |
| 3,098,945 | 7/1963 | Lemmers | 313/493 |
| 3,157,362 | 11/1964 | Waly | 362/84 |
| 3,988,633 | 10/1976 | Shurgan et al. | 313/493 |
| 4,099,090 | 7/1978 | Corth et al. | 313/487 |
| 4,236,096 | 11/1980 | Tiemann | 313/1 |
| 4,264,147 | 4/1981 | Baur et al. | 350/345 |
| 4,500,173 | 2/1985 | Leibowitz et al. | 350/345 |
| 4,546,417 | 10/1985 | Watts | 362/84 |
| 4,641,925 | 2/1987 | Gasparaitis et al. | 350/345 |
| 4,736,134 | 4/1988 | Lagushenko et al. | 313/493 |
| 4,744,012 | 5/1988 | Bergkvist | 362/84 |
| 4,799,050 | 1/1989 | Prince et al. | 340/765 |
| 4,822,617 | 11/1989 | Vriens | 358/60 |
| 4,825,125 | 4/1989 | Lagushenko et al. | 313/493 |
| 4,841,155 | 6/1989 | Ushida et al. | 250/463.1 |
| 4,845,408 | 7/1989 | Pai | 315/238 |
| 4,874,228 | 10/1989 | Aho et al. | 362/339 |
| 4,976,514 | 12/1990 | Murata et al. | 362/260 |
| 4,989,956 | 2/1991 | Wu et al. | 350/345 |
| 5,021,931 | 6/1991 | Matsui et al. | 362/84 |
| 5,211,467 | 5/1993 | Seder | 362/84 |

*Primary Examiner*—Ira S. Lazarus
*Assistant Examiner*—Y. Quach
*Attorney, Agent, or Firm*—Kenneth J. Johnson; Ronald E. Champion

[57] ABSTRACT

Fluorescent lamp energy efficiency is improved by providing geometric formations on the surface to which the phosphor coating is applied. By such geometric formations, a greater oblique surface area is available for receiving a desirably thin phosphor coating such that greater and more uniform visible light output is obtained from the device for a given energy input, i.e., greater relative to that possible with smooth surfaces receiving the phosphor coating. In the illustrated embodiment, the interior surfaces of an enclosure include V-shaped groove formations for increasing the interior surface area and establishing oblique orientation relative to approaching UV light rays. A UV light source is placed within the enclosure for excitation of a phosphor coating applied to the interior surfaces of the enclosure. The invention is particularly well adapted for use as a backlighting system in an active matrix liquid crystal display device.

5 Claims, 2 Drawing Sheets

HIGH EFFICIENCY FLUORESCENT LAMP DEVICE

BACKGROUND OF THE INVENTION

The present invention relates generally to fluorescent lamp technology, and particularly to improved efficiency of fluorescent lamps used as backlight in, for example, AMLCD (Active Matrix Liquid Crystal Display) devices.

Light produced by a conventional fluorescent lamp is a result of excited phosphor exposed to ultra-violet (UV) light energy, e.g., generated from a mercury vapor arc stream passing through a tube having phosphor on its interior surface.

Obtaining maximum light energy output for a given power input to a fluorescent lamp used as a backlight in an AMLCD is an important operational feature. In particular, an AMLCD transmits very little of the backlight provided. For a color AMLCD, only 2.5 to 4% of the backlight passes through the AMLCD. For monochrome applications, up to 12% of the backlight passes through the AMLCD. In either case, an efficient backlight must be provided to maximize light output from the display device. The backlight produced must be as efficient as possible to maintain desired light output while minimizing power dissipation, i.e., heat generated. The lumens (light out) per watt (power in) conversion in an LCD backlight system can be taken as a measure of efficiency of a fluorescent lamp backlight system. Thus, the greater the lumens per watt conversion efficiency the more effective the fluorescent lamp device is as a backlight system in an AMLCD device.

Fluorescent lamps provide the best lumens per watt conversion efficiency relative to most practical light sources. Despite this highly efficient character of fluorescent lamps relative to other types of lighting devices, further improvement in the efficiency of conventional fluorescent backlights is desirable especially for backlighting in AMLCD applications.

According to another aspect of fluorescent backlight systems, a suitably bright and uniform light output is desired. Uniformity in light output can be obtained by significant separation between the UV light source and the phosphor coating producing visible light. For example, if the UV light source is separated by more than several feet from the phosphor, the resulting visible light issuing from the phosphor appears well distributed and uniform. Unfortunately, in many applications, including avionic display devices such as contemplated under the present invention, such separation between the UV light source and phosphor producing visible light is simply not possible. For avionic display devices, the LCD must operate in a small and highly constrained environment not well suited for producing uniform light output. As a result, many avionic display devices employing an LCD in conjunction with a backlight embodying a tubular, and possibly serpentine, fluorescent lamp suffer from a lack of uniform light output.

Fluorescent coatings, in conventional fluorescent lamp manufacturing, result from a phosphor slurry drawn into a glass tube, i.e., lamp envelope, then allowed to run out of the tube. The residual phosphor slurry material, i.e., that left on the interior walls of the glass tube, is refined through baking to remove binder material that would undesirably outgas and absorb UV light and cause a loss in light output. The result of this phosphor coating process is a moderately uniform layer of phosphor on the inside of the tube. It is known in the industry that an ideal or "optimum" phosphor coating is on the order of three to five phosphor particles thick; the average phosphor particle size being in the micro meter ($10^{-6}$) range. Excitation efficiency drops for coatings thicker than the optimum thickness because some emitted light is reabsorbed within the phosphor layer, and light output efficiency falls accordingly. Likewise, phosphor coatings thinner than the optimum thickness do not capture all the potential light producing ultra-violet photons generated by the mercury arc stream. Light output is then less than that possible for the amount of power provided to the lamp in producing the arc. As used herein, the terms "relatively thin" and "relatively thick" presented in reference to a phosphor coating shall refer to the thickness of the phosphor coating as being either thinner or thicker, respectively, than the above-noted "optimum" phosphor coating thickness.

The prevailing rule for manufacturing fluorescent lamps is that relatively thin phosphor coatings are better and more economical than relatively thick phosphor coatings. High volume manufacturing processes will not support an optimum phosphor coating thickness. Because phosphor coatings tend to be slightly less than optimum, i.e., relatively thin, there is a portion of UV light energy not absorbed by the phosphor coating. The energy contained in the unabsorbed UV light represents a loss or inefficiency of the system because the unabsorbed UV light is not used by the phosphor to produce fluorescence.

The process for creating a compact fluorescent lamp light source for a backlight in LCD devices further compounds the problems of non-uniformity and inefficiency, i.e., loss of UV photons, for fluorescent lamps. In conventional LCD backlighting systems, a serpentine configuration is provided by bending a straight fluorescent lamp, i.e., usually bending a fluorescent lamp tube having an interior phosphor coating in place. Under such method of manufacture, it is difficult or impossible to provide a uniform phosphor coating on the inside of the bent tube. First, to bend the lamp it is necessary to heat the lamp to very near the melting point of the glass tube. Exposure of the phosphor coating to this high heat degrades the phosphor coating, and thereby causes inefficiency with respect to energy applied to the lamp. Second, bending the lamp increases the length of the tube on the outside of the bend and decreases the length on the inside of the bend. This stretching and compressing of the glass tube causes thinning and thickening, respectively, of the phosphor coating relative to the phosphor coating in the straight portions of the tube. Consequently, when the lamp is illuminates the bent regions are darker than the straight portions of the lamp causing additional non-uniformity in light output.

It is desirable, therefore, that a fluorescent lamp as a backlight for an LCD be more efficient with respect to the utilization of the available ultraviolet light by the phosphor coating to produce visible light. Furthermore, it is desirable that a fluorescent lamp used as a backlight in an LCD produce a uniform output in a size-constrained device such as an avionic flight display device.

The subject matter of the present invention addresses these concerns of the prior fluorescent lamp arrangements and provides a more efficient and more uniform light output for a fluorescent backlight in an LCD device especially as applied to an avionic display instrument.

SUMMARY OF THE INVENTION

In accordance with one aspect of the present invention, energy efficiency of a fluorescent lamp is improved by provision of surface formations defining the surface to which phosphor elements are bound. Such surface formations provide a relatively greater surface area with much of the surface area at an oblique orientation relative to a radius drawn perpendicular to the longitudinal axis of the source of radian energy. Conventional lamps have a smooth surface receiving the phosphor elements, with the smooth surface being substantially perpendicular to the longitudinal axis of the source of radiant energy (arc). By providing a greater surface and oblique orientation area for the phosphor coating, it is possible while using a practical, relatively thin phosphor coating to expose a relatively greater amount of phosphor to UV photon bombardment and provide a longer UV light path through the coating. In this manner, a greater light output is produced for a given energy input because more phosphor is positioned to capture the UV light energy and, therefore, more visible light is produced without increasing total power input.

In accordance with a preferred embodiment of the present invention, UV light is produced by mercury arc in a clear tube, i.e., a tube transparent to UV light and without a phosphor coating on the interior walls. This mercury arc producing tube is then positioned within an enclosure. The interior side and back walls of the enclosure are coated with phosphor. By providing surface formations on the interior walls of the enclosure, a relatively greater surface area of oblique orientation relative to approaching UV light rays is made available to receive the phosphor coating, a greater amount of phosphor is exposed to the UV light, and greater light output is thereby produced. A panel provides the exit window for visible light issuing from the device, and may further include phosphor coating and similar surface formations on its interior surface.

In accordance with a preferred embodiment of the present invention, the surface formations provided may take the form of a series of parallel adjacent V-shaped grooves. A second series of parallel adjacent V-shaped grooves may be further provided in orthogonal relation to the first series of V-shaped grooves. The resulting surface contour is an array of pyramid formations providing increased light output. Because the light-producing phosphor surface is more distant from the UV generating arc stream, the resulting visible light flux is made more uniform. Furthermore, the array of pyramid formations provides, with respect to approaching UV light rays, an oblique orientation relative to the layer of phosphor coating thereon. As a result of such oblique orientation in approach, the UV light rays encounter a longer path through the phosphor coating and thereby have greater opportunity for capture and production of visible light. Thus, the arrangement provides both uniform and greater light output with a relatively thin phosphor coating and a given magnitude of UV light produced.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION OF THE INVENTION

It is generally recognized that a relatively thin phosphor coating, rather than a relatively thick phosphor coating, inside a fluorescent lamp is a practical approach in producing suitable light output of the excited phosphor coating. Under conventional practice, such a phosphor coating is applied to the smooth interior walls of a mercury arc producing tube. Under the present invention, however, by providing surface contouring of the portion of the lamp receiving the phosphor coating, it is possible to maintain the relatively thin coating of phosphor while exposing a relatively greater mass of phosphor to the UV light. In the preferred embodiment of the present invention, this is achieved by putting the phosphor coating on the interior surfaces of a secondary enclosure also containing a UV light source and establishing an oblique surface orientation relative to approaching UV light rays to present a longer UV light path through the relatively thin phosphor coating.

Figure 1:
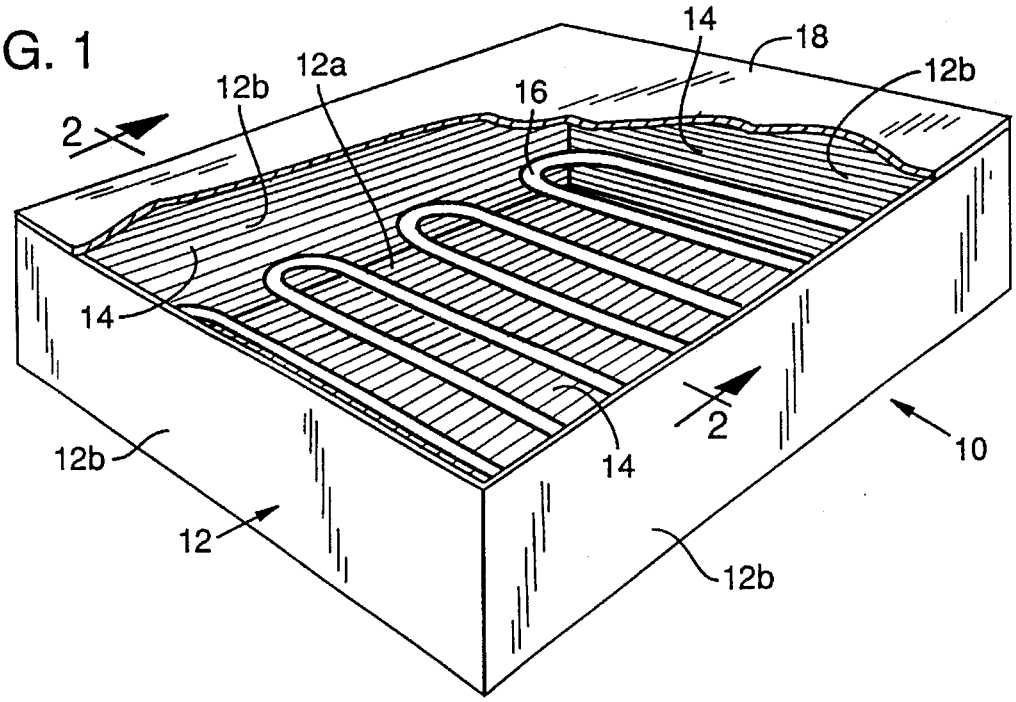
FIG. 1 is a perspective view partially broken away of a preferred embodiment of the present invention as used in a backlighting system for an LCD device as applied to an avionic instrument display.
Figure 2:
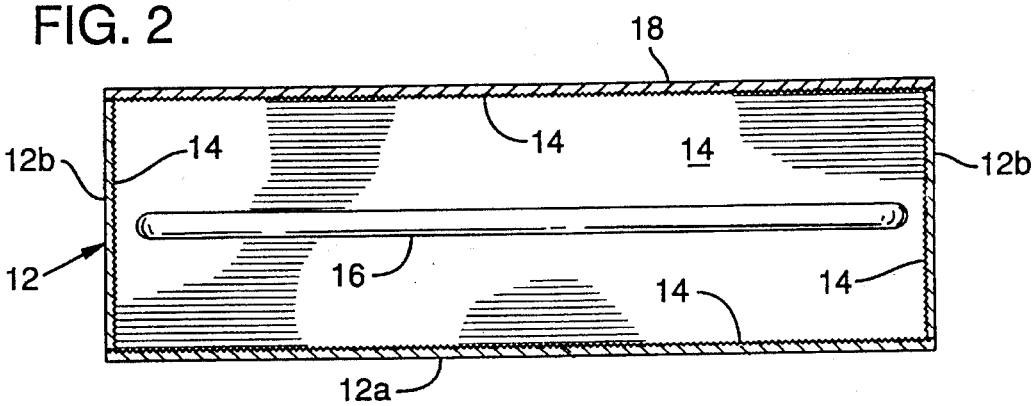
FIG. 2 is a sectional view of the device of FIG. 1 as taken along lines 2—2 of FIG. 1 to further illustrate use of interior surface contouring for increasing the surface area available for receiving a phosphor coating and providing oblique orientation relative to approaching UV light rays.

FIG. 1 illustrates in perspective view and FIG. 2 in sectional view a preferred embodiment of the present invention, a backlight system 10. System 10 includes an opaque enclosure 12 comprising a floor 12*a* and four side walls 12*b* arranged generally as an open-top box configuration. A mercury arc producing tube 16, generally arranged in serpentine fashion, lies along and substantially overlays floor 12*a* of box 12. More particularly, the plane of tube 16 is parallel to and spaced from floor 12*b*, i.e., intermediate the floor 12*a* and open top of box 12. Also, and as illustrated in FIG. 1, the geometry of tube 16 leaves substantial open area between adjacent legs of the tube 16 so as not to block visible light emission from floor 12*a* of box 12. An exit window 18, shown partially broken away, rests upon the enclosure 12, i.e., at the top edges of the side walls 12*b* and in face-to-face spaced relation to the floor 12*a*. An information presenting display device, e.g., an active matrix liquid crystal display device (not shown), can then be placed over the exterior surface of exit window 18 to make use of visible light exiting the enclosure such as in an avionic instrument display. Many types of information presenting display devices could be placed over the exterior surface of exit window 18, all which utilize the backlight produced by backlighting system 10.

The mercury arc producing tube 16 contains no phosphor coating and is responsible solely for producing UV light within the enclosure 12. The interior surfaces of enclosure 12, i.e., the inward facing surfaces of walls **12*b*, the upward facing surface of floor 12*a*, and, optionally, the downward facing surface of exit window 18, include a phosphor coating 14 which reacts to the UV light produced by tube 16 by producing visible light. Coating 14 may be applied by a variety of methods, airbrushing is considered a suitable coating technique. As may be appreciated, the interior surfaces of enclosure 12 provide much greater surface area receiving the phosphor coating 14 than that available on the interior walls of the tube 16. Furthermore, as discussed below, the interior surfaces of enclosure 12 carrying the phosphor coating 14 lie at generally oblique angles relative to the oncoming UV light rays. Accordingly, each UV light ray approaching the phosphor coating at such oblique angle has a longer path of exposure to the phosphor particles in coating 14. This orientation establishes a greater probability of a phosphor particle capturing a given UV light photon and producing visible light. As may be appreciated, the thickness of the phosphor coating 14 may vary within enclosure 12. More particularly, the coating 14 at the downward facing surface exit window 18 should be precisely applied to provide, as is in conventional practice, a relatively thin coating, e.g., on the order of three to five phosphor particles thick. When such phosphor coating is applied to the exit window, it provides the added benefit of diffusing light generated in the cavity of box 12**, further benefiting the desirable characteristic of backlight uniformity.

Figure 3:
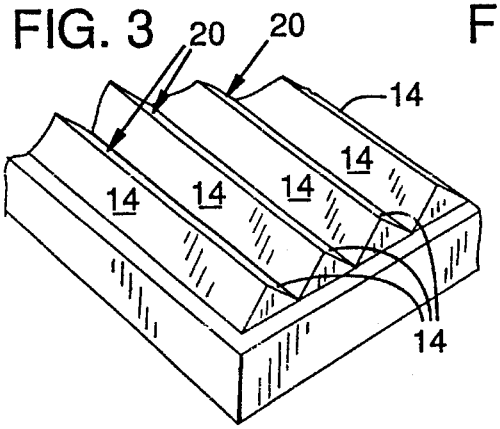
FIG. 3 illustrates in greater detail the surface contouring arrangement of FIGS. 1 and 2.

With reference to FIG. 3, to further increase the available surface area and oblique orientation for phosphor coating 14, the interior surfaces of the enclosure 12 include surface formations providing relatively greater and oblique surface area exposed to UV light. More particularly, each of the interior surfaces of the enclosure 12 include a series of parallel adjacent V-shaped grooves 20 which cumulatively provide greater surface area than that of a flat or smooth interior surface arrangement. The orientation of the V-shaped grooves on the various interior surfaces of enclosure 12 can vary. All the grooves 20 need not be parallel to one another. The grooves are, however, in the preferred embodiment closely spaced so as to form a ridge between each groove 20. In other words, according to this preferred groove arrangement substantially no flat interior surfaces of the enclosure 12 remain. Spacing the grooves 20 apart would leave some of the original flat surfaces of the interior wall, but such would result in less oblique oriented surface area available relative to that shown herein where the grooves are immediately adjacent one another and define a ridge therebetween.

Figure 4:
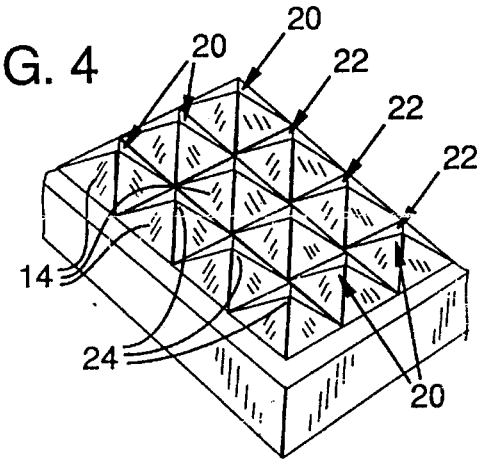
FIG. 4 illustrates an alternative surface contouring arrangement for providing more uniform light output than that possible under the embodiment of FIG. 3.

FIG. 4 illustrates an enhancement applicable to the device of FIGS. 1–3 providing the same surface area for receiving the phosphor coating, but producing a more uniform, i.e., well dispersed or diffuse, light output. In FIG. 4, the interior surfaces of enclosure 12 are provided with the V-shaped grooves 20 as discussed above, and further with another series of similar V-shaped grooves 22 but in orthogonal relation to the grooves 20. In this configuration, the interior surfaces of the enclosure 12 have pyramid formations 24 wherein each flat surface of each pyramid is suitably exposed to the UV light produced by tube 16 and also carries the phosphor coating 14 thereon. It is believed that the arrangement of pyramid formations 24 on the interior surfaces of the enclosure 12 provides the maximum surface area available for receiving the phosphor coating 14 and maintaining this phosphor coating 14 suitably exposed to the UV light. The arrangement of FIG. 4 produces the most uniform light output.

Figure 5:
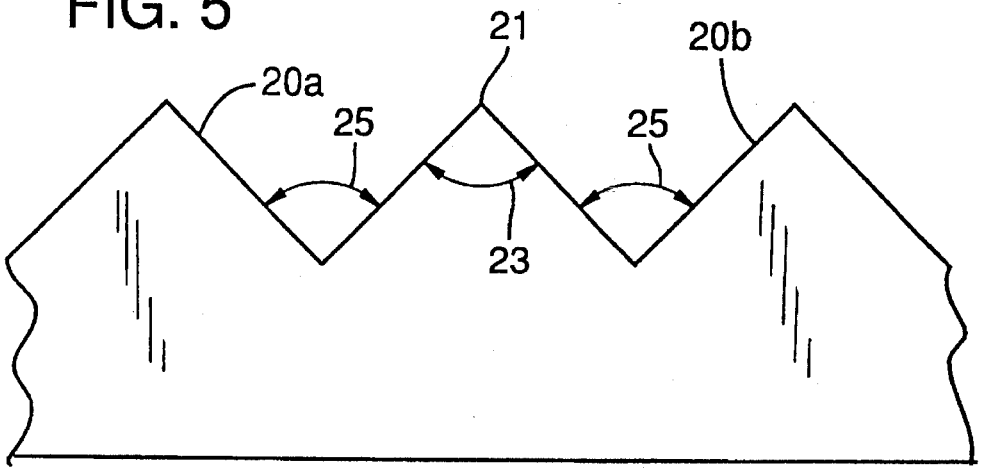
FIG. 5 further illustrates geometric details of the surface contouring arrangement under the present invention.

In the preferred form of the present invention, the V-shaped grooves 20 and 22 are 90° V-groove patterns for optimally increasing the available surface area of a phosphor coated region. FIG. 5 further illustrates such geometric aspects of the grooves 20 and 22. In FIG. 5, two V-shaped grooves 20 are shown, individually **20*a* and 20*b*, but should be considered representative of the formation of grooves 22. In FIG. 5, V-shaped groove 20*a* is immediately adjacent V-shaped groove 20*b*, and in parallel relation thereto. An apex or line ridge 21 results as the boundary between adjacent V-shaped grooves 20*a* and 20*b*. The angle 23 between adjacent flat surfaces of the grooves 20*a* and 20*b* is 90°. Similarly, the angle 25 at the base of each groove 20, i.e., between the two flat surfaces of each groove 20, is 90°. By producing the grooves 20*a* and 20*b*** according to this geometry, a substantial oblique surface area is available for receiving the phosphor coating and suitably exposing the phosphor coating to a source of UV light.

Consider a flat plate measuring 5 inches by 5 inches and providing a surface area of 25 square inches. The same flat plate cut with 90° V-grooves 20 has an increase in surface area of 1.414 times, or 35.4 square inches. By cutting additional V-grooves 22 orthogonal to the first grooves 20, the increase in surface area relative to the original flat surface is the same, but the resulting geometric pattern of pyramid formations 24 produces more uniform light output.

These patterns can be applied to all interior surfaces of the enclosure 12, including the interior facing surface of the window 14. Manufacturing of the enclosure 12 with such groove patterns is considered to be a simple matter of machining or molding the material selected for the body of enclosure 12. The window 14 can be hot pressed from a glass or polymer substrate with appropriate mold pattern.

Figure 6:
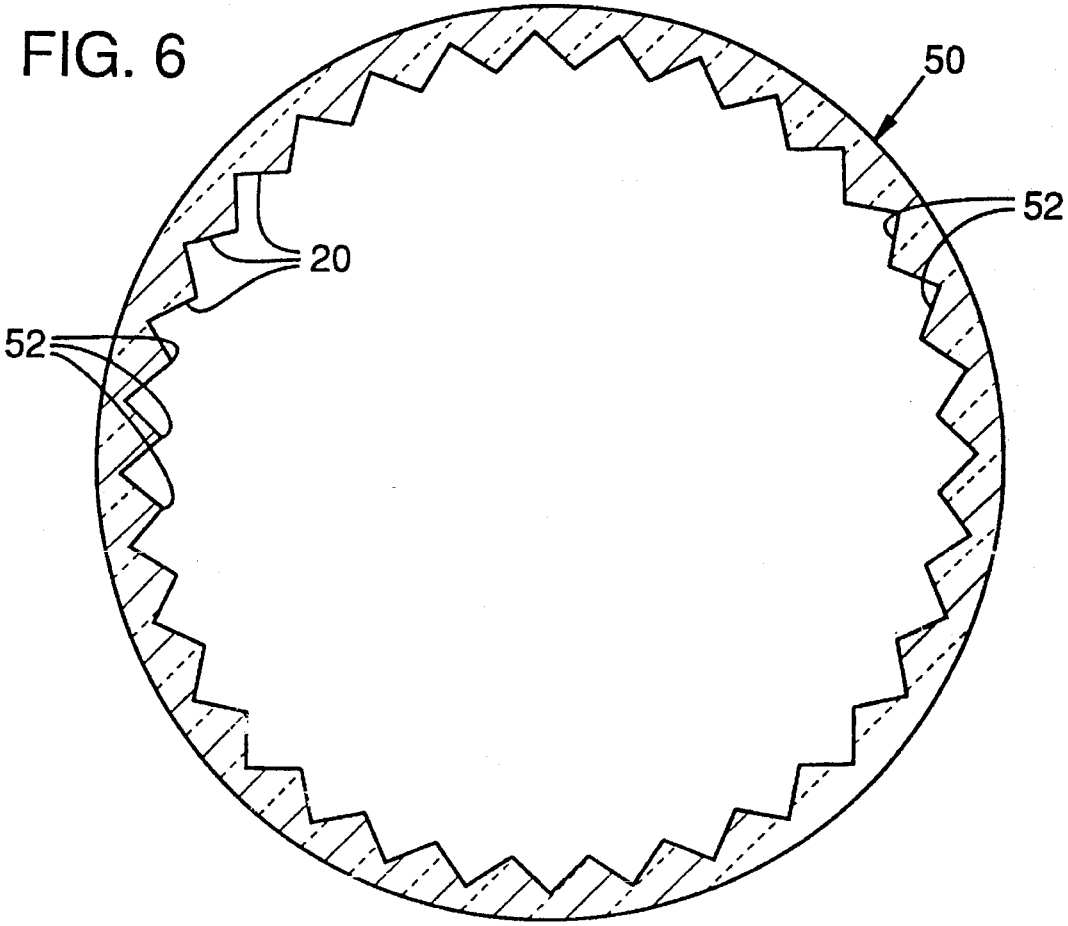
FIG. 6 is a sectional view of a fluorescent tube having a surface contouring on its interior surface for receiving a phosphor coating.

Certain aspects of the present invention may be applied to tubular fluorescent lamps, but the manufacturing process could be more difficult and possibly add costs. For instance, as shown in FIG. 6, one could form a glass tube 50 over a mandrel (not shown) which is cut with a V-grooved pattern to obtain a tube 50 with V-shaped grooves 20 along the length of its interior surface. Tube 50 then has more interior surface area at desirable orientation relative to the longitudinal axis of the lamp for receiving a phosphor coating 52. Overall efficiency of the fluorescent lamp is thereby enhanced by more efficient use of the UV light produced. More particularly, no light absorbing features reside between the phosphor coating and the UV generating arc stream. All tube materials, however, have some spectral absorbing characteristics. For phosphor outside the lamp, the lamp tube absorption must be minimized for the range of energies to which the phosphor responds.

Thus, by increasing the phosphor-receiving relatively thin surface area and its orientation relative to approaching UV light rays, more light may be produced relative to that of a flat interior surface area of a lamp envelope of identical exterior dimensions. In other words, for a lamp producing the same UV flux density, the present invention provides greater visible light output because more phosphor, as provided in a relatively thin coating, is suitably exposed to the UV light. The UV light is then more efficiently used. In addition to an increased light output with the same input power, uniformity of light output is significantly increased. Both gains are considered particularly desirable in flat panel LCD backlighting schemes.

This invention has been described herein in considerable detail in order to comply with the Patent Statutes and to provide those skilled in the art with the information needed to apply the novel principles and to construct and use such specialized components as are required. However, it is to be understood that the invention is not restricted to the particular embodiment that has been described and illustrated, but can be carried out by specifically different equipment and devices, and that various modifications, both as to the equipment details and operating procedures, can be accomplished without departing from the scope of the invention itself.

The embodiments of the invention in which an exclusive property or right is claimed are defined as follows:

1. A backlight for a liquid crystal display comprising:

an enclosure having an interior facing floor surface connected to interior facing side wall surfaces, and an open top;

a serpentine tube providing UV light located within said enclosure;

a plurality of grooves disposed in said interior facing side walls and said interior facing floor surface wherein a phosphor coating is disposed over said grooves in said interior facing side wall surfaces and said interior facing floor surface and the grooves are positioned relative to the serpentine tube to provide visible light in a uniform fashion when the UV light reacts with the phosphor coating;

an exit window positioned at said open top of said enclosure which allows passage of visible light therethrough, said exit window defining an interior ceiling surface for said enclosure wherein additional grooves with a phosphor coating are disposed on said interior ceiling surface.

2. A backlight according to claim 1 wherein said plurality of grooves is divided into individual grooves sets for each of said interior facing sidewall surfaces and said interior facing floor surface, and each of said individual groove sets and said additional grooves comprise parallel adjacent V-shaped grooves.

3. A backlight according to claim 2 wherein said V-shaped grooves define adjacent surfaces oriented at substantially ninety degrees relative to one another.

4. A backlight according to claim 1 wherein said plurality of grooves is divided into individual grooves sets for each of said interior facing sidewall surfaces and said interior facing floor surface, and each of said individual groove sets and said additional grooves comprise a first series of adjacent parallel V-shaped grooves and a second series of adjacent parallel V-shaped grooves, the first and second series of grooves being in orthogonal relation to define said interior facing floor surface, said interior facing side wall surfaces, and said interior ceiling surface as a collection of pyramid shaped formations.

5. A backlight according to claim 4 wherein adjacent surfaces of adjacent pyramid formations lie at substantially ninety degrees relative to one another.

* * * * *